US009395654B2

(12) United States Patent
Suzuki et al.

(10) Patent No.: US 9,395,654 B2
(45) Date of Patent: Jul. 19, 2016

(54) IMAGE FORMING APPARATUS HAVING SIMPLE AND COMPACT CONFIGURATION TO SEPARATE SECONDARY TRANSFER MEMBER FROM PRIMARY TRANSFER BELT

(71) Applicant: CANON KABUSHIKI KAISHA, Tokyo (JP)

(72) Inventors: Kazushi Suzuki, Suntou-gun (JP); Chikara Imaizumi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/696,275

(22) Filed: Apr. 24, 2015

(65) Prior Publication Data

US 2015/0309447 A1 Oct. 29, 2015

(30) Foreign Application Priority Data

Apr. 28, 2014 (JP) ..... 2014-092383

(51) Int. Cl.
*G03G 15/16* (2006.01)
*G03G 15/01* (2006.01)

(52) U.S. Cl.
CPC ..... *G03G 15/1605* (2013.01); *G03G 15/0136* (2013.01); *G03G 15/167* (2013.01); *G03G 2215/0132* (2013.01)

(58) Field of Classification Search
CPC ..... G03G 15/165; G03G 15/0136
USPC ..... 399/121
See application file for complete search history.

(56) References Cited

U.S. PATENT DOCUMENTS 7,505,712 B2 * 3/2009 Kaiho ..... G03G 15/0136 399/121

FOREIGN PATENT DOCUMENTS

JP 2001-296716 A 10/2001
JP 2010-019964 A 1/2010

* cited by examiner

*Primary Examiner* — Walter L Lindsay, Jr.
*Assistant Examiner* — Milton Gonzalez
(74) *Attorney, Agent, or Firm* — Canon USA, Inc., IP Division

(57) ABSTRACT

An image forming apparatus includes a lever configured to move a secondary transfer roller from an endless belt. The lever is arranged between a primary transfer surface of the endless belt, which opposes a plurality of image bearing members between an opposing roller and a stretching roller, and a surface opposing the primary transfer surface. The lever is engaged with the secondary transfer roller to separate the secondary transfer roller from the endless belt. Such a simple contact-separation configuration for the secondary transfer roller achieves reduction in size and space of the image forming apparatus.

16 Claims, 10 Drawing Sheets

IMAGE FORMING APPARATUS HAVING SIMPLE AND COMPACT CONFIGURATION TO SEPARATE SECONDARY TRANSFER MEMBER FROM PRIMARY TRANSFER BELT

BACKGROUND OF THE INVENTION

1. Field of the Invention

The present invention relates to an image forming apparatus for forming an image using an electrophotographic method, and more particularly, to an image forming apparatus, such as a copying machine, a printer, a facsimile machine, and a multifunction peripheral, including an endless belt stretched around stretch rollers.

2. Description of the Related Art

An electrophotographic color image forming apparatus includes pressure contact members such as a primary transfer roller and a secondary transfer roller. Each of the pressure contact members is urged by an urging member to press and contact a surface of an endless belt such as an intermediate transfer belt with a predetermined pressure. If a long time period has elapsed in a state that these pressure contact members are pressing and contacting the intermediate transfer belt, a creep phenomenon occurs. This causes plastic deformation such as a curl of the intermediate transfer belt.

Generally, at a secondary transfer nip, since a relatively high transfer bias is applied to form a transfer electric field on a transfer material such as paper through which it is difficult to conduct electricity. Thus, abnormal discharge caused by the high voltage needs to be prevented at the secondary transfer nip. Accordingly, the secondary transfer roller is arranged to be offset on an upstream side in a sheet conveyance direction with respect to a secondary transfer opposing roller inside the intermediate transfer belt. At that time, there is an area in which only the intermediate transfer belt and the secondary transfer roller contact each other. Such an area is called a tension nip area.

Moreover, a pressing force of the secondary transfer roller is set relatively high to enhance adhesiveness between the secondary transfer roller and the intermediate transfer belt. In a case where the tension nip area is left for a long time in a state of being pressed and contacted with a high pressure, a curl occurs on the intermediate transfer belt with a recess toward the outside. The curl of the intermediate transfer belt reduces not only adhesiveness between a photosensitive drum and the intermediate transfer belt at a primary transfer nip portion, but also adhesiveness between the intermediate transfer belt and the secondary transfer roller at a secondary transfer nip portion. Such reduction in adhesiveness causes generation of an abnormal image such as transfer unevenness.

Accordingly, the secondary transfer roller needs to be separated from the intermediate transfer belt while the intermediate transfer belt is stopped, for example, when the image forming apparatus is in a power-off state or a print standby state, to solve such a problem. Various configurations have been discussed to separate the secondary transfer roller from the intermediate transfer belt.

Japanese Patent Application Laid-Open No. 2001-296716 discusses a configuration in which a stretching member and a secondary transfer member, arranged inside an intermediate transfer belt to apply tension to the intermediate transfer belt, are separated from the intermediate transfer belt.

In Japanese Patent Application Laid-Open No. 2001-296716, however, a reciprocating rod for causing the secondary transfer member to contact and be separated from the intermediate transfer belt and a horizontal rod for causing a primary transfer member to contact and be separated from the intermediate transfer belt are different members. Consequently, such a configuration obstructs further reduction in size and space of a transfer unit and the image forming apparatus.

SUMMARY OF THE INVENTION

The present invention is directed to an image forming apparatus capable of reducing size and space thereof by simplifying a contact separation configuration for a secondary transfer member.

According to an aspect of the present invention, an image forming apparatus includes a photosensitive member configured to bear a toner image, a transfer unit to which the toner image is primarily transferred from the photosensitive member, and including an endless belt configured to contact the photosensitive member and circularly move, a contact member arranged corresponding to the photosensitive member and configured to contact and be separated from the belt, and a moving member configured to move to cause the contact member to contact and be separated from the belt, a secondary transfer member configured to contact and be separated from an outer peripheral surface of the belt to secondarily transfer the toner image from the belt to a transfer material, and an urging member configured to urge the secondary transfer member toward the transfer unit, wherein the moving member includes an acting portion configured to cause the secondary transfer member to move in a direction opposite to an urging direction of the urging member, and a movement of the moving member moves the contact member and the secondary transfer member.

Further features of the present invention will become apparent from the following description of exemplary embodiments with reference to the attached drawings.

DESCRIPTION OF THE EMBODIMENTS

Hereinafter, various exemplary embodiments of the present invention are described in detail. However, dimensions, materials, shapes, and relative arrangements of components described in the exemplary embodiments can be changed appropriately according to configurations or various conditions of an apparatus of the present invention. Therefore, the descriptions below are not intended to limit the scope of the present invention, unless otherwise specified.

Figure 1:
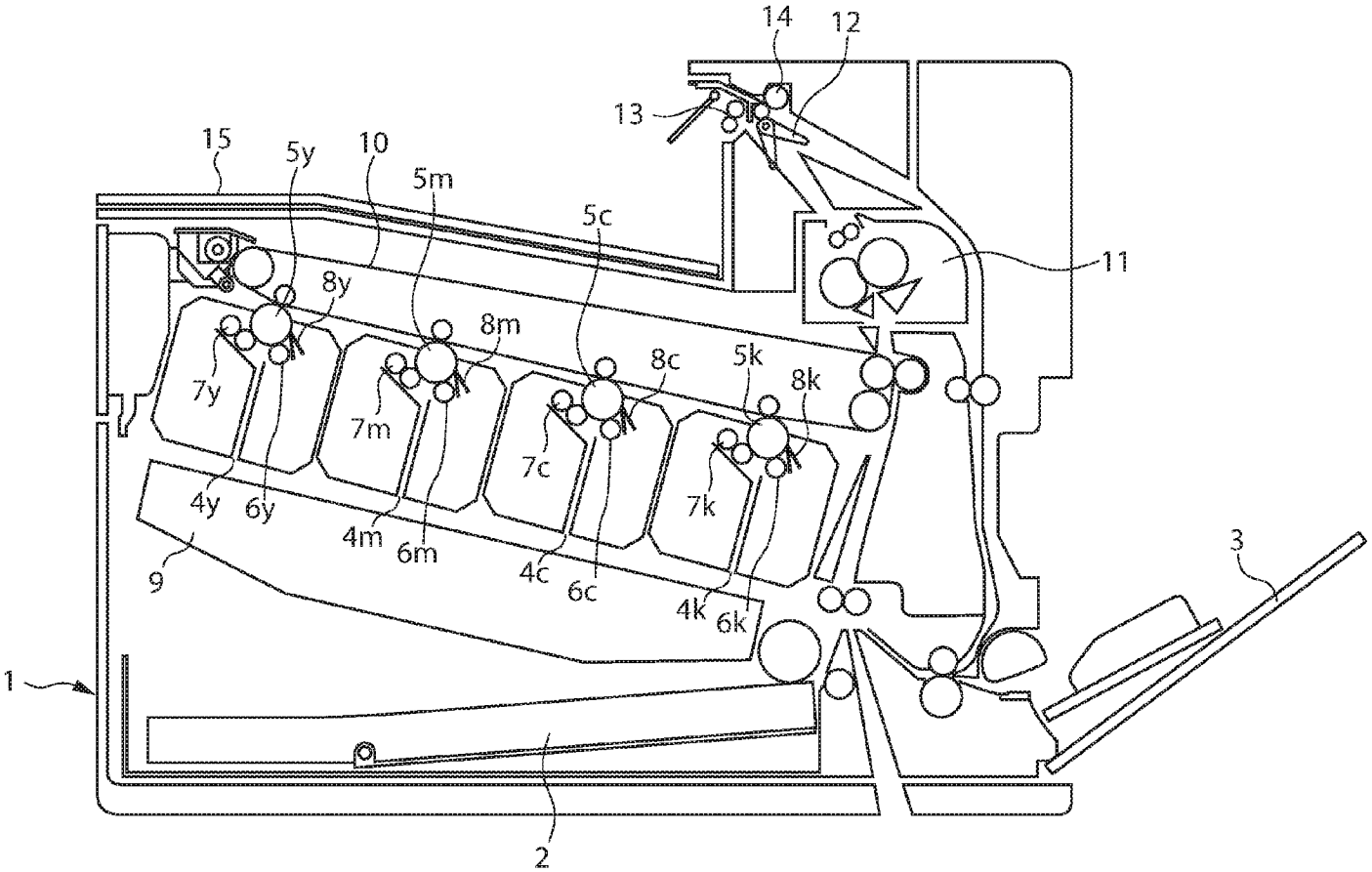
FIG. 1 is a sectional view illustrating an image forming apparatus according to a first exemplary embodiment.

A first exemplary embodiment of the present invention is described using an electrophotographic color image forming apparatus of a four-drum type. In the present exemplary embodiment, a full-color laser beam printer is described as an example of the color image forming apparatus. FIG. 1 is a sectional view illustrating an overall configuration of a full-color laser printer 1 (hereinafter, referred to as a printer 1).

The printer 1 includes a cassette 2 and a manual feed unit 3. The cassette 2 is housed to be drawable in a lower portion of the printer 1, whereas the manual feed unit 3 is arranged on the right side in FIG. 1. Transfer materials are stacked and stored in each of the cassette 2 and the manual feed unit 3 so that the transfer materials are separated and fed one by one from each of the cassette and the manual feed unit 3. The printer 1 includes process cartridges 4*y*, 4*m*, 4*c*, and 4*k* (also referred to as process cartridges 4) serving as image forming units for yellow, magenta, cyan, and black, respectively. These process cartridges 4 are aligned side by side, and each of the process cartridges 4 is detachable from the printer 1.

The process cartridges 4*y*, 4*m*, 4*c*, and 4*k* respectively include photosensitive drums 5*y*, 5*m*, 5*c*, and 5*k* (also referred to as photosensitive drums 5) serving as photosensitive members, and charging members 6*y*, 6*m*, 6*c*, and 6*k* (also referred to as charging members 6). The charging members 6 uniformly and negatively charge surfaces of the respective photosensitive drums 5. Moreover, the process cartridges 4*y*, 4*m*, 4*c*, and 4*k* respectively include developing rollers 7*y*, 7*m*, 7*c*, and 7*k* (also referred to as developing rollers 7), and photosensitive member cleaning blades 8*y*, 8*m*, 8*c*, and 8*y* (also called photosensitive member cleaning blades 8). Each of the developing rollers 7 used to provide toner to a corresponding electrostatic latent image to develop the electrostatic latent image as a toner image. The photosensitive member cleaning blades 8 remove residual toner from the respective photosensitive drums 5.

The developing rollers 7 can contact and be separated from the photosensitive drums 5. The developing rollers 7 contact and are separated from the respective photosensitive drums 5 according to electrostatic latent images, thereby enhancing the lifetime of the developing rollers 7. The printer 1 includes a scanner unit 9 (a charging unit) disposed below the process cartridges 4. The scanner unit 9 emits laser beams based on image information to form electrostatic latent images on the photosensitive drums 5. Moreover, the printer 1 includes an intermediate transfer unit 10 disposed above the process cartridges 4. The intermediate transfer unit 10 is described in detail below.

After the developing rollers 7 develop the electrostatic latent images on the respective photosensitive drums 5 with toner, the toner images on the photosensitive drums 5 are transferred to a transfer material by primary transfer and secondary transfer. Subsequently, the transfer material passes a fixing device 11 in which the transferred toner image is fixed onto the transfer material. Then, a duplex flapper 12 switches a conveyance path of the transfer material, so that the transfer material is conveyed to either a discharge roller pair 13 or a switchback roller pair 14. If the transfer material is transferred to the switchback roller pair 14, the transfer material is switched back by the switchback roller pair 14 and then conveyed to the discharge roller pair 13. After passing the discharge roller pair 13, the transfer material is discharged to a transfer material stacking unit 15.

Figure 2:
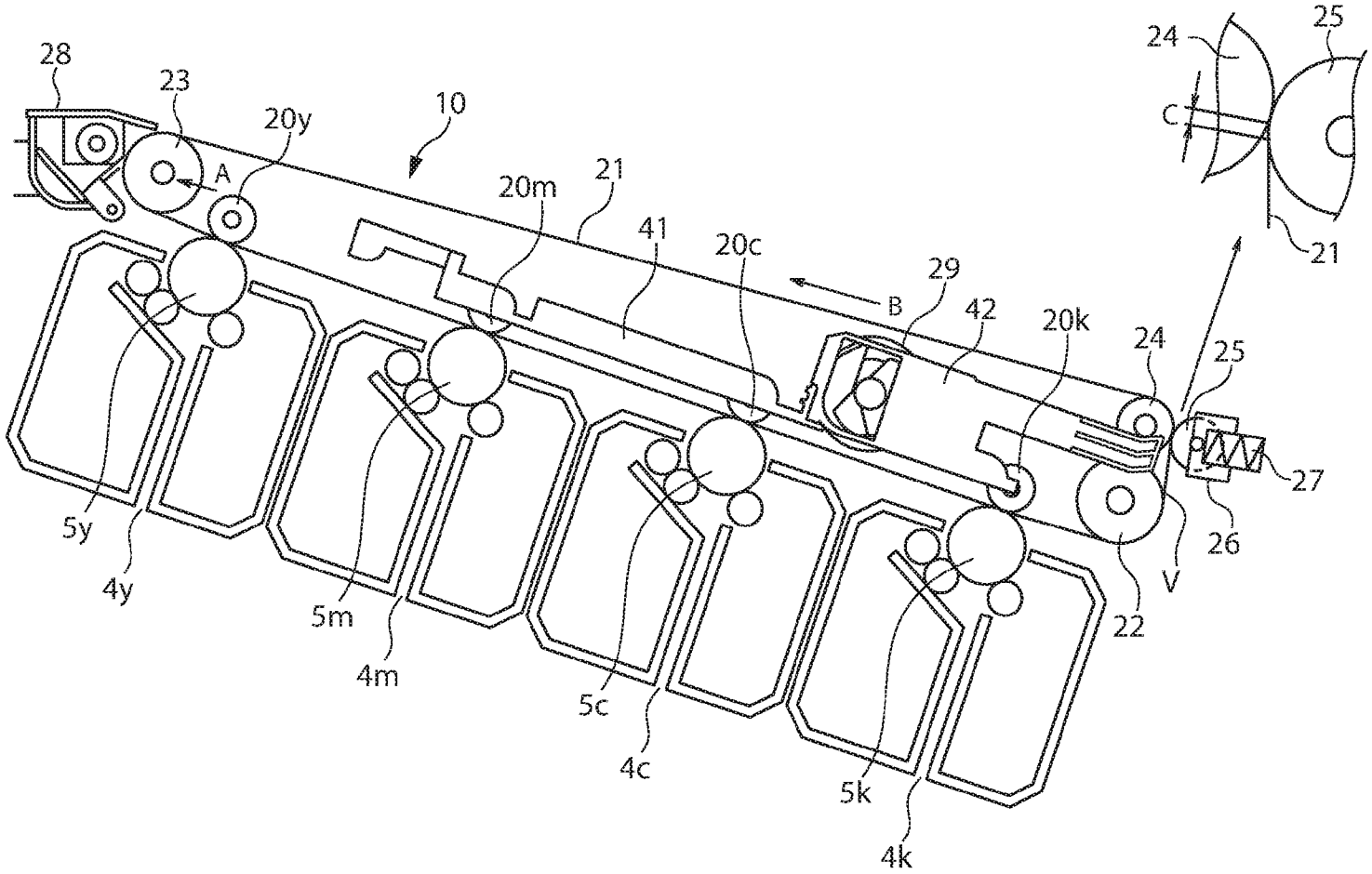
FIG. 2 is a sectional view illustrating an intermediate transfer unit and the periphery thereof when a full-color image is formed by the image forming apparatus according to the first exemplary embodiment.

Next, the intermediate transfer unit 10 is described in detail with reference to FIG. 2. FIG. 2 is a sectional view illustrating the intermediate transfer unit 10 and the periphery thereof when a full-color image is formed by the printer 1.

The intermediate transfer unit 10 is detachable from an apparatus main body of the printer 1. The intermediate transfer unit 10 includes primary transfer rollers 20 (primary transfer rollers 20*y*, 20*m*, 20*c*, and 20*k* for yellow, magenta, cyan, and black, respectively) serving as contact members, an intermediate transfer belt 21, a drive roller 22, a tension roller 23, and a secondary transfer opposing roller 24. The intermediate transfer belt 21 is an endless belt in a cylindrical shape. The intermediate transfer belt 21 is stretched around the drive roller 22, the tension roller 23, and the secondary transfer opposing roller 24 serving as an opposing roller. Theses rollers serve as stretching rollers. The intermediate transfer belt 21 can contact the photosensitive drums 5, and makes a circular movement. The secondary transfer opposing roller 24 serving as a first stretching roller is disposed opposing a secondary transfer roller 25 via the intermediate transfer belt 21. The tension roller 23 serving as a third stretching roller is urged by an urging member (not illustrated) in a direction indicated by an arrow A illustrated in FIG. 2. This applies a predetermined tension to the intermediate transfer belt 21. When the drive roller 22 serving as a second stretching roller is rotated by a motor (not illustrated) disposed in the apparatus main body of the printer 1, the intermediate transfer belt 21 circularly moves in a direction indicated by an arrow B illustrated in FIG. 2 at a predetermined speed. The secondary transfer roller 25 can contact and be separated from a surface V of the intermediate transfer belt 21, the surface V being formed between the drive roller 22 and the secondary transfer opposing roller 24 illustrated in FIG. 2.

The primary transfer is performed at primary transfer portions formed by the primary transfer rollers 20 and the respective photosensitive drums 5. In the primary transfer, a positive bias voltage is applied to each of the primary transfer rollers 20 to generate a potential difference between the primary transfer roller 20 and the negatively charged surface of the corresponding photosensitive drum 5. With such a potential difference, the toner is transferred to the intermediate transfer belt 21.

When a monochrome image is formed by the image formation of the present exemplary embodiment, the printer 1 uses only the process cartridge 4*k* of black. The printer 1 forms a black toner image on the photosensitive drum 5*k*, and transfers the toner image to a transfer material via the intermediate transfer belt 21 to acquire a monochrome image.

On the other hand, when a full-color image is formed, the printer 1 uses all the process cartridges 4*y*, 4*m*, 4*c*, and 4*k*. The printer 1 sequentially forms toner images of yellow, magenta, cyan, and black on the photosensitive drums 5*y*, 5*m*, 5*c*, and 5*k*, respectively. Subsequently, the printer 1 transfers these toner images to a transfer material via the intermediate transfer belt 21 to acquire a full-color image.

In the monochrome image formation, rotation of the photosensitive drums 5*y*, 5*m*, and 5*c* is stopped to suppress abrasion of surfaces of the photosensitive drums 5*y*, 5*m*, and 5*c*. Herein, the intermediate transfer belt 21 making a circular movement should not rub the photosensitive drums 5*y*, 5*m*, and 5*c*. Accordingly, when the monochrome image is formed, a first separation unit separates the primary transfer rollers 20*y*, 20*m*, and 20*c* from the intermediate transfer belt 21. The first separation unit is described in detail below.

Moreover, in a case where the primary transfer portion is formed while the printer 1 is in a standby state or a power-off state, the primary transfer roller 20 creeps. This causes plastic deformation of the primary transfer roller 20. If the primary transfer roller 20 is plastically deformed, adhesiveness between the photosensitive drum 5 and the intermediate transfer belt 21 is reduced at the primary transfer nip portion, causing an abnormal image such as transfer unevenness. Thus, when the printer 1 is in a standby state or a power-off state, the first separation unit separates all the primary transfer rollers 20 from the intermediate transfer belt 21 to prevent generation of such an abnormal image. The first separation unit is described below.

The contact and separation of the primary transfer rollers 20 and the intermediate transfer belt 21 is performed by rotation of a separation shaft unit 29 that is disposed between the primary transfer roller 20*c* and the primary transfer roller 20*k*. The separation shaft unit 29 includes a shaft for transmitting a driving force from the apparatus main body of the printer 1, and a cam portion 38 including a first cam and a second cam provided on the shaft. The separation shaft unit 29 includes the first separation unit and a second separation unit, which will be described below. A detailed description of the separation shaft unit 29 will be given below.

The secondary transfer is performed at a secondary transfer portion formed by the secondary transfer opposing roller 24 and the secondary transfer roller 25. Both of shaft ends of the secondary transfer roller 25 are rotatably held by bearings 26. The secondary transfer roller 25 presses the secondary transfer opposing roller 24 via the intermediate transfer belt 21 by using a spring 27 serving as a second urging member, thereby forming the secondary transfer nip.

At the secondary transfer nip, to form a transfer electric field on a transfer material such as paper through which it is difficult to conduct electricity, a relatively high transfer bias is applied. Therefore, the secondary transfer roller 25 is disposed to offset on an upstream side in a sheet conveyance direction with respect to the secondary transfer opposing roller 24, so that a tension nip area C illustrated in FIG. 2 is provided.

Moreover, in a case where there is a small air gap at a secondary transfer nip portion, abnormal electric discharge occurs. Hence, a transfer material and the secondary transfer roller 25 serving as a transfer bias applying member need to have good adhesiveness therebetween. Accordingly, the spring 27 serving as an urging member for the secondary transfer roller 25 is generally set to have a relatively strong force. In the present exemplary embodiment, the spring 27 is set to have an urging force of 50 N.

In a case where the secondary transfer roller 25 is left for a long time in a state of being pressed and contacted with high pressure, a curl occurs on the intermediate transfer belt 21 with a recess toward the outside in the tension nip area. The curl of the intermediate transfer belt 21 reduces adhesiveness between the photosensitive drums 5 and the intermediate transfer belt 21 at the respective primary transfer portions, and adhesiveness between the intermediate transfer belt 21 and the secondary transfer roller 25 at the secondary transfer portion. Such reduction in adhesiveness causes generation of an abnormal image such as transfer unevenness. Therefore, the second separation unit for causing the secondary transfer roller 25 to contact and be separated from the intermediate transfer belt 21 is provided to prevent the curl of the intermediate transfer belt 21. The second separation unit will be described in detail below.

The intermediate transfer unit 10 includes a cleaning unit 28 for removing residual toner from the intermediate transfer belt 21, the residual toner remaining on the intermediate transfer belt 21 without being transferred to a transfer material at the secondary transfer portion. The cleaning unit 28 is disposed on an upstream side of the primary transfer portion formed by the photosensitive drum 5*y* and the primary transfer roller 20*y*, and a downstream side of the secondary transfer portion in a rotation direction (a direction indicated by an arrow B illustrated in FIG. 2) of the intermediate transfer belt 21. The toner removed by the cleaning unit 28 is conveyed to and stored in a toner collection container (not illustrated) disposed on a downstream side of the cleaning unit 28.

Figure 3:
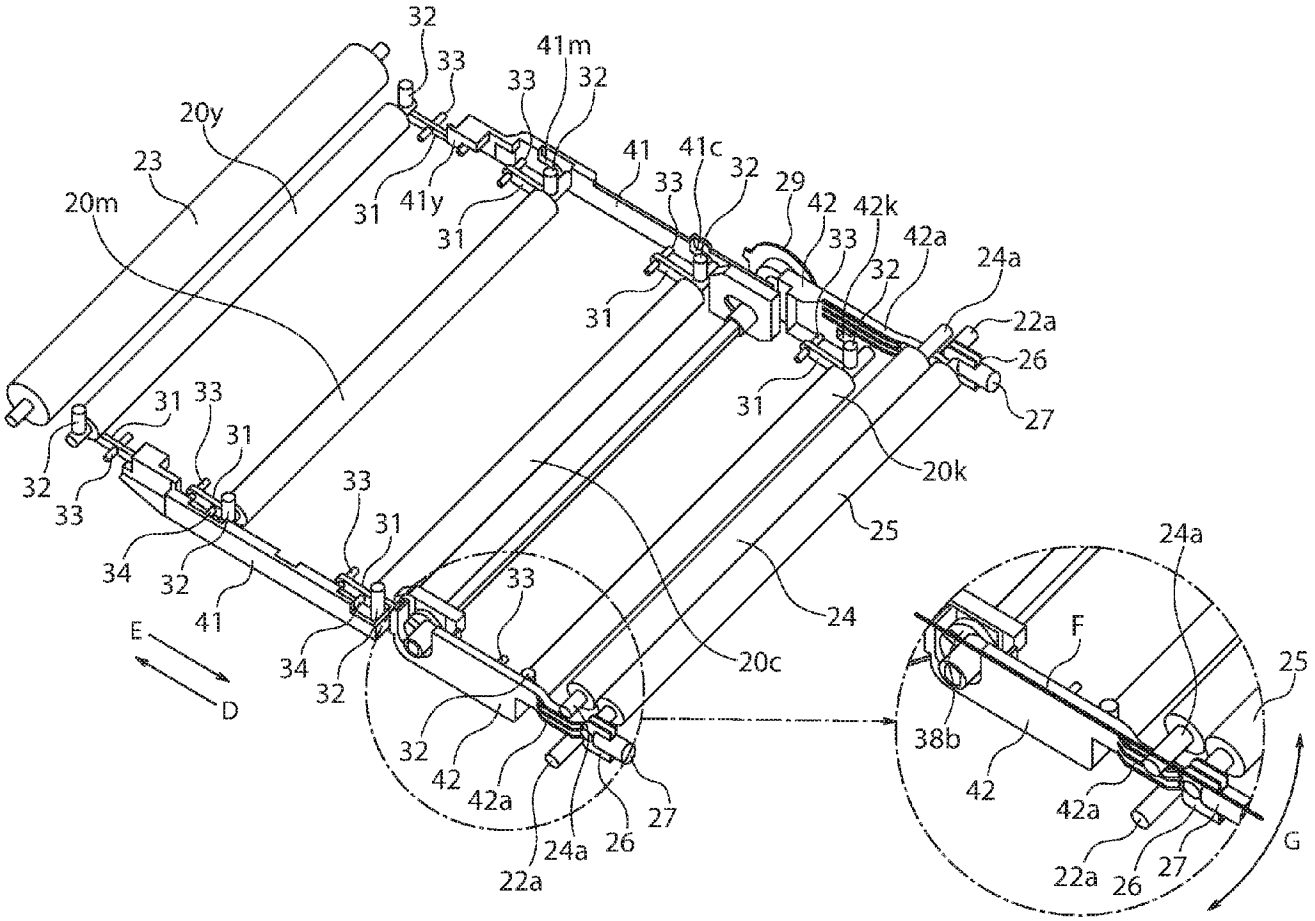
FIG. 3 is a perspective view illustrating the primary transfer unit illustrated in FIG. 2 as seen from diagonally above when an intermediate transfer belt according to the first exemplary embodiment is removed.
Figure 4:
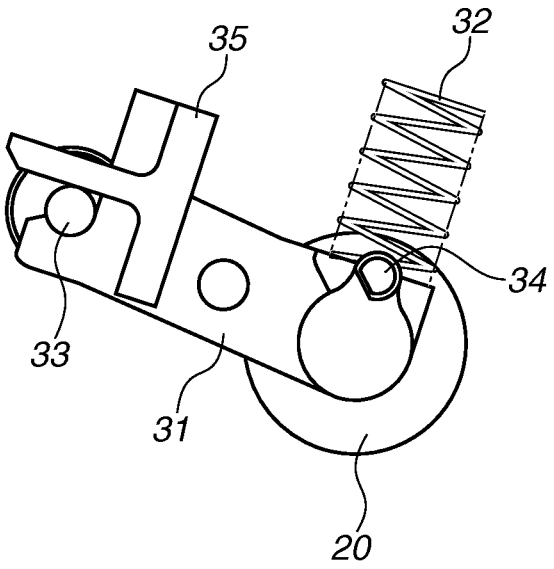
FIG. 4 is a diagram illustrating a bearing configuration.
Figure 5:
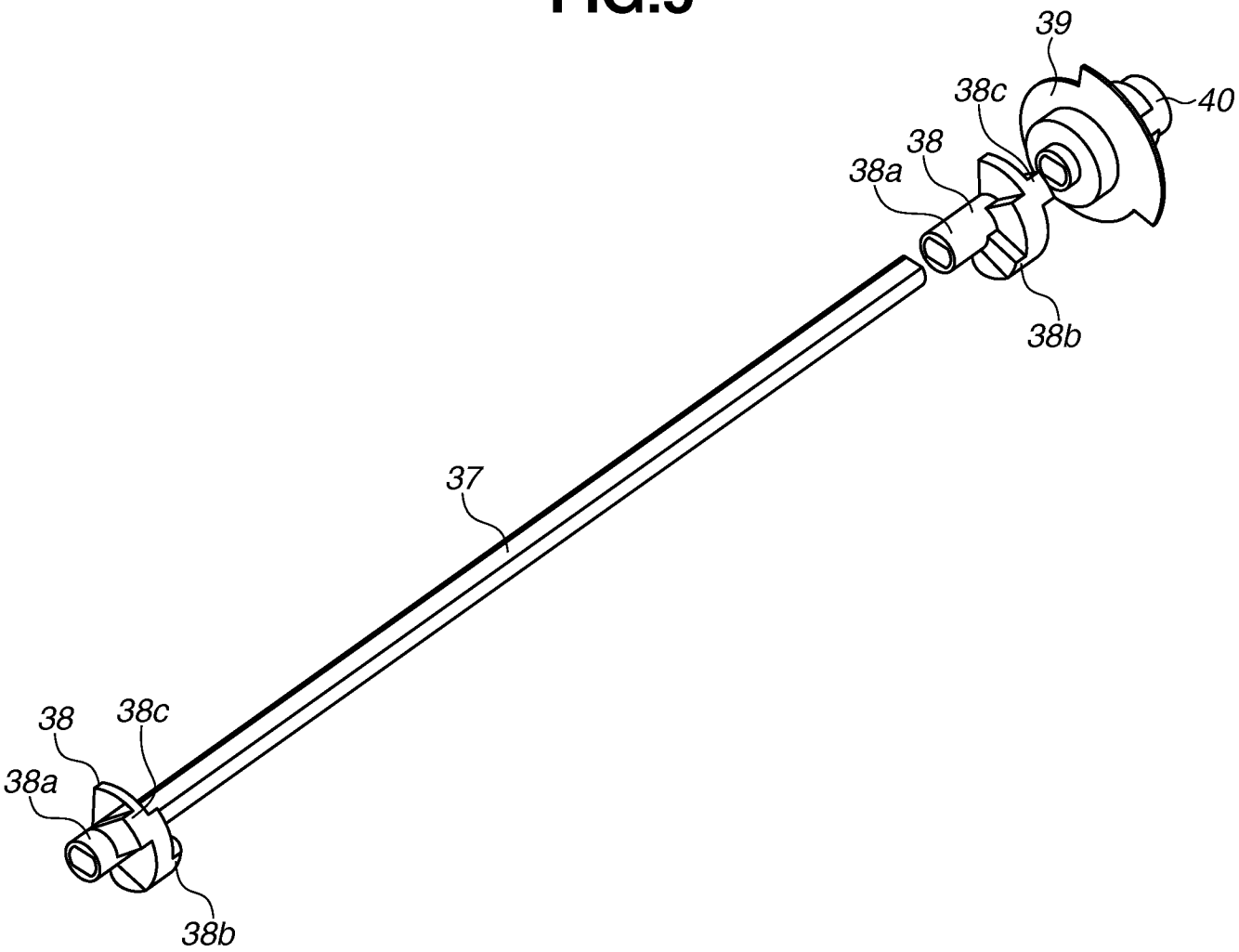
FIG. 5 is a perspective view illustrating components of a separation shaft unit according to the first exemplary embodiment, as seen from diagonally above.

Next, configurations of the first and second separation units are described with reference to FIGS. 3, 4, and 5. The first separation unit and the second separation unit cause the primary transfer rollers 20 and the secondary transfer roller 25 to contact and be separated from the intermediate transfer belt 21 according to image formation such as a monochrome image and a full-color image. FIG. 3 is a perspective view illustrating the intermediate transfer unit 10 illustrated in FIG. 2 as seen from diagonally above in a state where the intermediate transfer belt 21 is removed. FIG. 4 is a diagram illustrating a configuration of a bearing 31. FIG. 5 is a perspective view illustrating components of the separation shaft unit 29, as seen from diagonally above.

As illustrated in FIG. 3, both of shaft ends of each of the primary transfer rollers 20 (20*y*, 20*m*, 20*c*, and 20*k*) are rotatably held by the respective bearings 31. The primary transfer rollers 20 press the respective photosensitive drums 5 via the intermediate transfer belt 21 by using springs 32 serving as first urging members, thereby forming respective transfer nips of the primary transfer portions. As illustrated in FIG. 4, the bearing includes a rotation fulcrum 33 and a hook 34. The rotation fulcrum 33 is pivotally held by a frame 35.

As illustrated in FIG. 5, the separation shaft unit 29 includes the shaft 37, the cam portions 38 provided on both ends of the shaft 37, a sensor light shielding plate 39, and a coupling 40. The shaft 37 is a metal plate that is bent in a U shape. Each of the cam portion 38, the sensor light shielding plate 39, and the coupling 40 is fixed to the shaft 37. A boss 38*a* of the cam portion 38 is engaged with a hole (not illustrated) on the frame 35, so that the separation shaft unit 29 is rotatably held. The separation shaft unit 29 is rotated by a driving force transmitted to the coupling 40 from a drive transmission unit (not illustrated) provided in the apparatus main body of the printer 1.

Moreover, as illustrated in FIG. 5, the cam portion 38 includes a cam (a first cam) 38*b* and a cam (a second cam) 38*c* that have different phases. These cams 38*b* and 38*c* are integrated with each other. As illustrated in FIG. 3, in the immediate vicinity of the bearing 31, a small lever (a moving member) 42, and a large lever (another moving member) 41 are slidably provided inside a frame (not illustrated) of the intermediate transfer unit 10. That is, the large lever 41 and the small lever 42 are provided within a region formed by an inner peripheral surface of the intermediate transfer belt 21.

The large lever 41 is engaged with the cam 38*b*, whereas the small lever 42 is engaged with the cam 38*c*. The large lever 41 serving as a first lever makes a reciprocating movement (to slide) according to rotation of the cam 38*b* serving as the first cam. The small lever 42 serving as a second lever makes a reciprocating movement (to slide) according to rotation of the cam 38*c* serving as the second cam. The reciprocating movements of the large and the small lever 42 with the rotation of the respective cams 38*b* and 38*c* are described below. Moreover, the large lever 41 and the small lever 42 are disposed without extending out from an upper surface and a lower surface of the intermediate transfer belt 21 (see FIG. 2).

In the present exemplary embodiment, the upper surface of the intermediate transfer belt 21 represents a primary transfer surface of the intermediate transfer belt 21. The primary transfer surface opposes the plurality of photosensitive drums 5 between the secondary transfer opposing roller 24 and the tension roller 23. The lower surface of the intermediate transfer belt 21 represents a surface between the drive roller 22 and the tension roller 23, and opposing the primary transfer surface. Thus, the large lever 41 and the small lever 42 are disposed without extending out from the primary transfer surface and the surface opposing the primary transfer surface of the intermediate transfer belt 21 (see FIG. 2).

With rotation of the separation shaft unit 29, the large lever 41 and the small lever 42 make reciprocating movements in directions indicated by arrows D and E illustrated in FIG. 3. Each of the cam portion 38, the large lever 41, and the small lever 42 is made of resin having good sliding property. In the present exemplary embodiment, polyoxymethylene (POM) is used for the cam portion 38, the large lever 41, and the small lever 42.

Moreover, the large lever 41 includes at least one first hook. The first hook moves interlocking with the reciprocating movement of the large lever 41 to separate at least one of the primary transfer rollers 20 from the intermediate transfer belt 21 while resisting an urging force of a spring. In the present exemplary embodiment, the large lever 41 includes planes 41*y*, 41*m*, and 41*c* serving as the first hooks. The large lever 41 and the separation shaft unit 29 form a first separation unit that separates the primary transfer rollers 20*y*, 20*m* and 20*c* from the intermediate transfer belt 21.

The small lever 42 includes at least one second hook. The second hook moves interlocking with the reciprocating movement of the small lever 42 to separate at least one of the primary transfer rollers 20 from the intermediate transfer belt 21 while resisting an urging force of a spring. In the present exemplary embodiment, the small lever 42 includes a plane 42*k* serving as the second hook. The small lever 42 and the separation shaft unit 29 form a first separation unit that separates the primary transfer roller 20*k* from the intermediate transfer belt 21. Moreover, the small lever 42 includes an arm 42*a* serving as an acting portion. The arm 42*a* moves interlocking with the reciprocating movement of the small lever 42 to separate the secondary transfer roller 25 from the intermediate transfer belt 21 while resisting the urging force of the spring 27. The small lever 42 and the separation shaft unit 29 form the second separation unit that separates the secondary transfer roller 25 from the intermediate transfer belt 21. Thus, the small lever 42 serves as a moving member including functions of the first separation unit and the second separation unit.

In FIG. 3, the large lever 41 and the small lever 42 illustrated on the rear side include the planes 41*y*, 41*m*, 41*c*, and 42*k*. Similarly, the large lever 41 and the small lever 42 on the front side in FIG. 3 include planes 41*y*, 41*m*, 41*c*, and 42*k* in positions substantially the same as those on the rear side, although reference numerals of these planes are not illustrated in FIG. 3.

The arm 42*a* of the small lever 42 is arranged between a metal core 22*a* of the drive roller 22 and a metal core 24*a* of the secondary transfer opposing roller 24 near the intermediate transfer belt 21 in such a manner that the arm 42*a* protrudes toward the secondary transfer roller 25. Moreover, the spring 27 presses an area of the bearing 26, the area being engaged with a metal core of the secondary transfer roller 25. The spring 27, the bearing 26, the arm 42*a*, and the cam 38*b* are arranged in substantially the same straight line. In other words, the spring 27, the bearing 26, the arm 42*a*, and the cam 38*b* are aligned in a straight line F illustrated in FIG. 3 at both ends in a width direction perpendicular to a rotational movement direction of the intermediate transfer belt 21. Thus, the small lever 42 and the arm 42*a* are not subjected to a momentum force (a force in a direction indicated by an arrow G illustrated in FIG. 3) applied by the spring 27. In the present exemplary embodiment, the configuration is described using the front side illustrated in FIG. 3. However, the configuration of the rear side is substantially the same as that of the front side.

Figure 6:
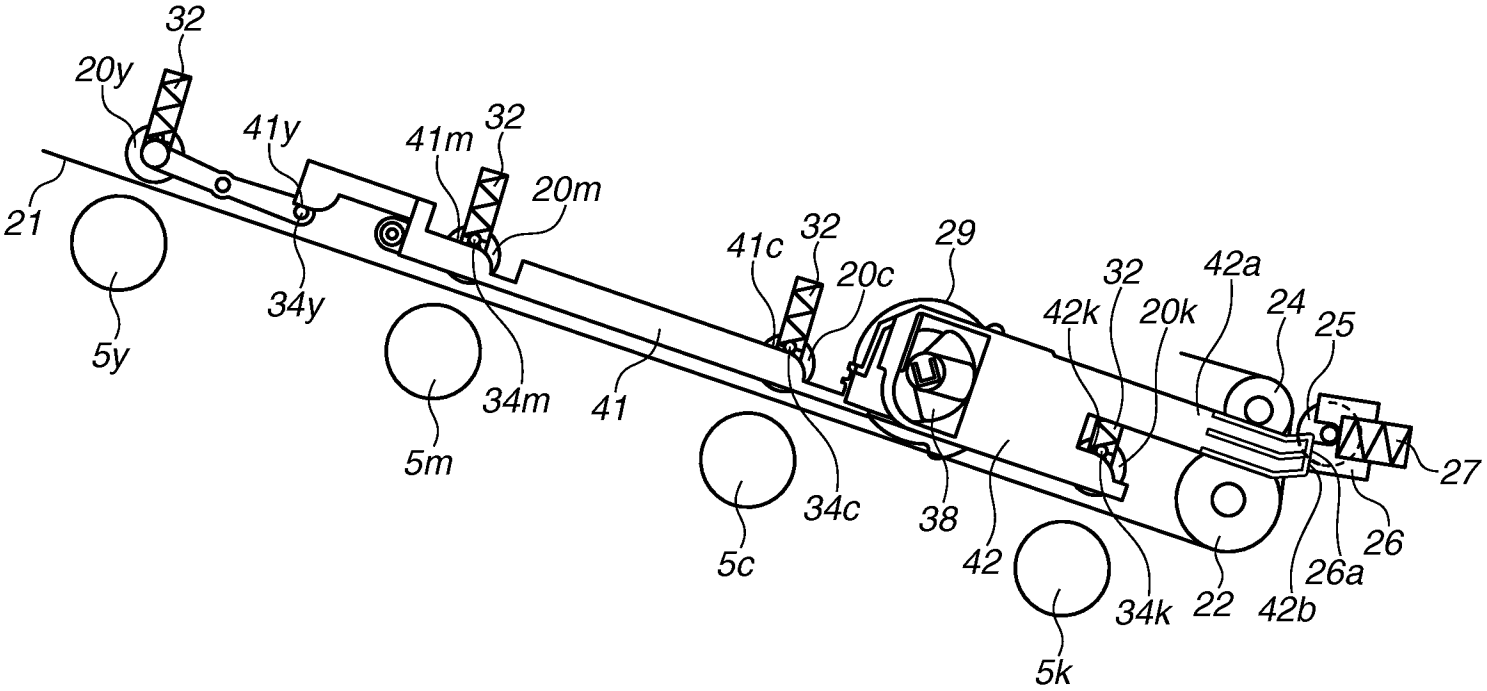
FIG. 6 is a diagram illustrating a state of a primary transfer roller and a secondary transfer roller (in an all separation state) when the image forming apparatus is in a print standby state.
Figure 7:
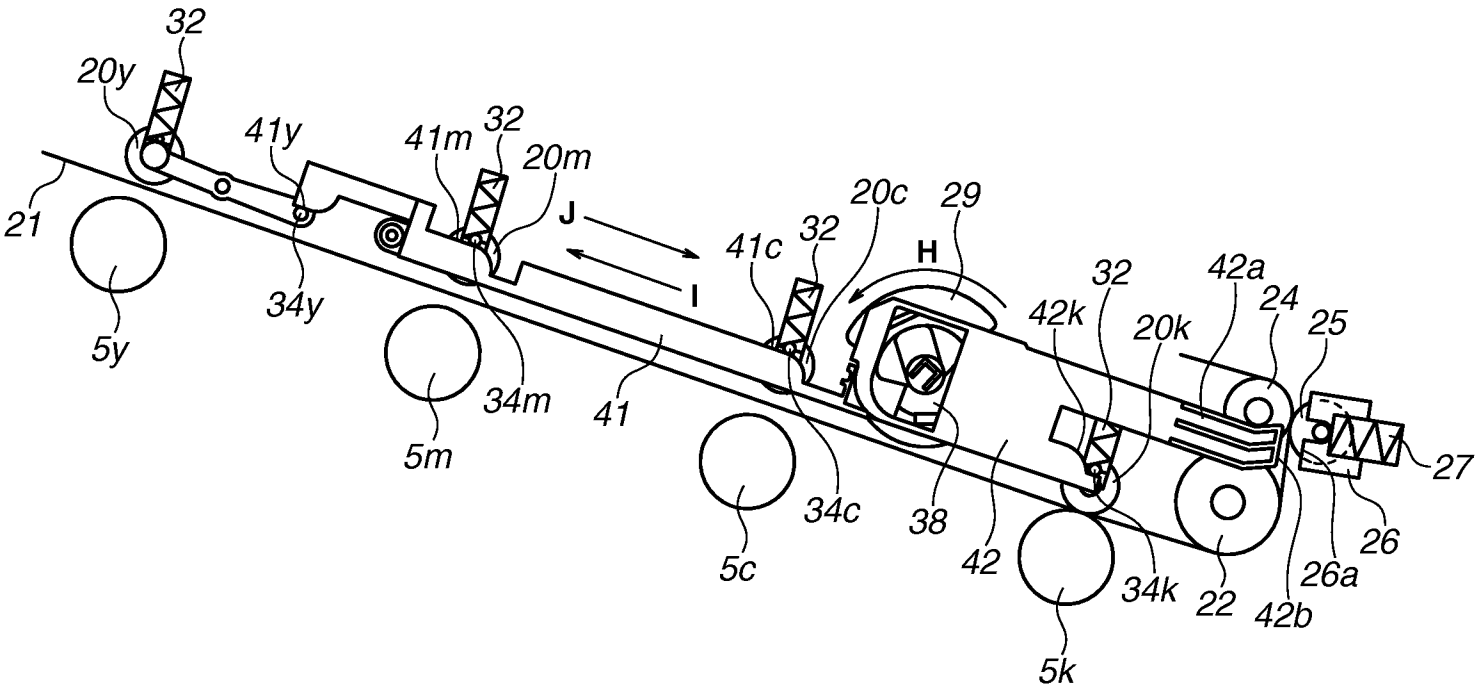
FIG. 7 is a diagram illustrating a state of the primary transfer roller and the secondary transfer roller when a monochrome image is formed by the image forming apparatus according to the first exemplary embodiment.
Figure 8:
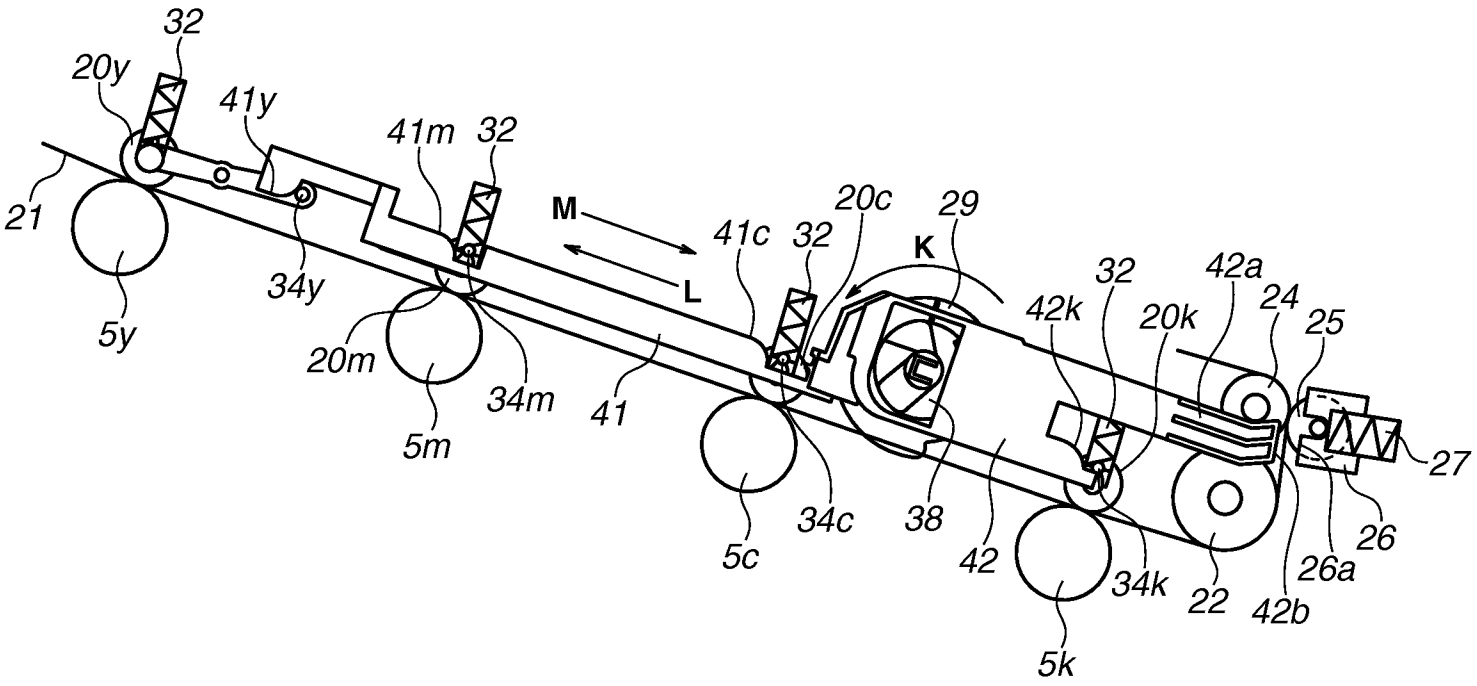
FIG. 8 is a diagram illustrating the primary transfer roller and the secondary transfer roller when a full-color image is formed by the image forming apparatus according to the first exemplary embodiment.

Next, a description is given of a state of the primary transfer rollers 20 and the secondary transfer roller 25 (in an all separation state) when the printer 1 is in a print standby state, with reference to FIG. 6. Moreover, FIG. 7 illustrates a state of the primary transfer rollers 20 and the secondary transfer roller 25 when the printer 1 forms a monochrome image. FIG. 8 illustrates a state of the primary transfer rollers 20 and the secondary transfer roller 25 when the printer 1 forms a full-color image.

As illustrated in FIG. 6, when the printer 1 is in a print standby state, the hooks 34 of the bearings 31 for the respective primary transfer rollers 20 are engaged with the planes of the large lever 41 and the small lever 42. More specifically, the hooks 34*y*, 34*m*, 34*c*, and 34*k* are engaged with the planes 41*y*, 41*m*, 41*c*, and 42*k*, respectively. Accordingly, a plane 42*b* of the arm 42*a* of the small lever 42 is engaged with a plane 26*a* provided on the bearing 26 of the secondary transfer roller 25, the plane 42*b* being positioned in a leading edge of the secondary transfer roller 25 side. Thus, all the primary transfer rollers 20 and the secondary transfer roller 25 are separated from the intermediate transfer belt 21.

When the printer 1 receives a print signal for formation of a monochrome image, the separation shaft unit is rotated by 120 degrees in a direction (a counterclockwise (CCW) direction) indicated by an arrow H illustrated in FIG. 7, and the small lever 42 is moved by the cam 38*c* in a direction indicated by an arrow I illustrated in FIG. 7. At that time, the cam 38*b* and the large lever 41 remain engaged with each other even after the separation shaft unit 29 is rotated by 120 degrees. Therefore, the large lever 41 does not move in the direction indicated by the arrow I illustrated in FIG. 7. The movement of the small lever 42 releases the engagement between the hook 34*k* and the plane 42*k*, and the engagement between the plane 42*b* and the plane 26*a*. Accordingly, the primary transfer roller 20*k* is moved by the urging force of the spring 32 to the intermediate transfer belt 21 side to press the photosensitive drum 5*k* via the intermediate transfer belt 21, thereby forming the primary transfer nip. The secondary transfer roller 25 is moved by the urging force of the spring 27 to the intermediate transfer belt 21 side to press the secondary transfer opposing roller 24 via the intermediate transfer belt 21, thereby forming the secondary transfer nip. After the primary and secondary transfers are finished, the separation shaft unit 29 is rotated by 240 degrees in the direction H (the CCW direction) illustrated in FIG. 7 at a predetermined timing, and the small lever 42 is moved by the cam 38*b* in a direction indicated by an arrow J illustrated in FIG. 7. This movement enables the hook 34*k* to be engaged with the plane 42*k*, and the plane 42*b* to be engaged with the plane 26*a*. Thus, all the primary transfer rollers 20 and the secondary transfer roller 25 are separated from the intermediate transfer belt 21. Therefore, a state of the primary transfer rollers 20 and the secondary transfer roller 25 returns to the state obtained when the printer 1 is in a print standby state illustrated in FIG. 6.

When the printer 1 receives a print signal of a full-color image formation, the separation shaft unit 29 is rotated by 240 degrees in a direction (a CCW direction) indicated by an arrow K illustrated in FIG. 8. The large lever 41 and the small lever 42 are moved by the respective cams 38*b* and 38*c* in a direction indicated by an arrow L illustrated in FIG. 8. Such movements release the engagements between the hook 34*y* and the plane 41*y*, the hook 34*m* and the plane 41*m*, the hook 34*c* and the plane 41*c*, and the hook 34*k* and the plane 42*k*. All the primary transfer rollers 20 are moved by the urging force of the springs 32 to the intermediate transfer belt 21 side to press the respective photosensitive drums 5 via the intermediate transfer belt 21, thereby forming the respective primary transfer nips. Then, the secondary transfer roller 25 is moved by the urging force of the spring 27 to the intermediate transfer belt 21 side to press the secondary transfer opposing roller 24 via the intermediate transfer belt 21, thereby forming the secondary transfer nip. After the primary and secondary transfers are completed, the separation shaft unit 29 is rotated by 120 degrees in a direction (a CCW direction) indicated by an arrow K illustrated in FIG. 8 at a predetermined timing. With the rotation of the separation shaft unit 29, the large lever 41 and the small lever 42 are moved by the respective cams 38*b* and 38*c* in a direction indicated by an arrow M illustrated in FIG. 8. With this movement, the hook 34*y*, the hook 34*m*, the hook 34*c*, the hook 34*k*, and the plane 42*b* are engaged with the plane 41*y*, the plane 41*m*, the plane 41*c*, the plane 42*k*, and the plane 26*a*, respectively. Thus, all the primary transfer rollers 20 and the secondary transfer roller 25 are separated from the intermediate transfer belt 21. Consequently, a state of the primary transfer rollers 20 and the secondary transfer roller 25 returns to the state obtained when the printer 1 is in a print standby state illustrated in FIG. 6.

Hereinafter, effects of the present exemplary embodiment are described. In the printer 1 serving as an image forming apparatus according to the present exemplary embodiment, the arm 42*a* for separating the secondary transfer roller 25 is arranged without extending out from the upper surface and the lower surface of the intermediate transfer belt 21. Moreover, the arm 42*a* is arranged between the shafts of the metal core 22*a* of the drive roller 22 and the metal core 24*a* of the secondary transfer opposing roller 24. Such arrangement can reduce the size and space of the printer 1 and the transfer unit. Moreover, the contact and separation of the primary transfer roller 20*k*, and the contact and separation of the secondary transfer roller 25 are performed by only the small lever 42. Such a contact and separation configuration for the primary transfer roller 20*k* and the secondary transfer roller 25 has achieved simplification and low cost, and the size and space of the printer 1 serving as the image forming apparatus can be reduced. Since the bearing 26 supporting the secondary transfer roller 25 as a separation target is pressed to separate the secondary transfer roller 25 from the intermediate transfer belt 21, a component tolerance is minimized. This enables the space between the intermediate transfer belt 21 and the secondary transfer roller 25 during the separation to be readily and stably secured. The spring 27, the bearing 26, and the arm 42*a* are arranged on substantially the same straight line. The arm 42*a* is not subjected to a momentum force by the spring 27, thereby preventing the creep deformation of the arm 42*a* toward the intermediate transfer belt 21. Therefore, the arm 42*a* can be arranged near the intermediate transfer belt 21. Such arrangement can reduce the size of the printer 1 and the transfer unit.

Moreover, since the arm 42*a* is arranged immediately near the intermediate transfer belt 21, the spring 27 is arranged on an inner side to the utmost extent in a roller longitudinal direction. This reduces a deflection amount of the secondary transfer roller 25, and a difference in nip width between the center and the end of the secondary transfer nip. Pressure of the spring for pressing the secondary transfer roller 25 may be increased with the speeding-up of operation of the image forming apparatuses. Even in such a case, a diameter of the metal core of the secondary transfer roller 25 does need to be increased. Therefore, good secondary transfer property can be achieved without increasing the cost of the secondary transfer roller 25.

A full-color laser beam printer according to a second exemplary embodiment of the present invention is described. A configuration of the printer according to the second exemplary embodiment is similar to that of the printer 1 according to the first exemplary embodiment except for a configuration of an intermediate transfer unit. Descriptions of components and configurations similar to those of the first exemplary embodiment are omitted, and the configuration of the intermediate transfer unit that differs from the first exemplary embodiment will be described.

Figure 9:
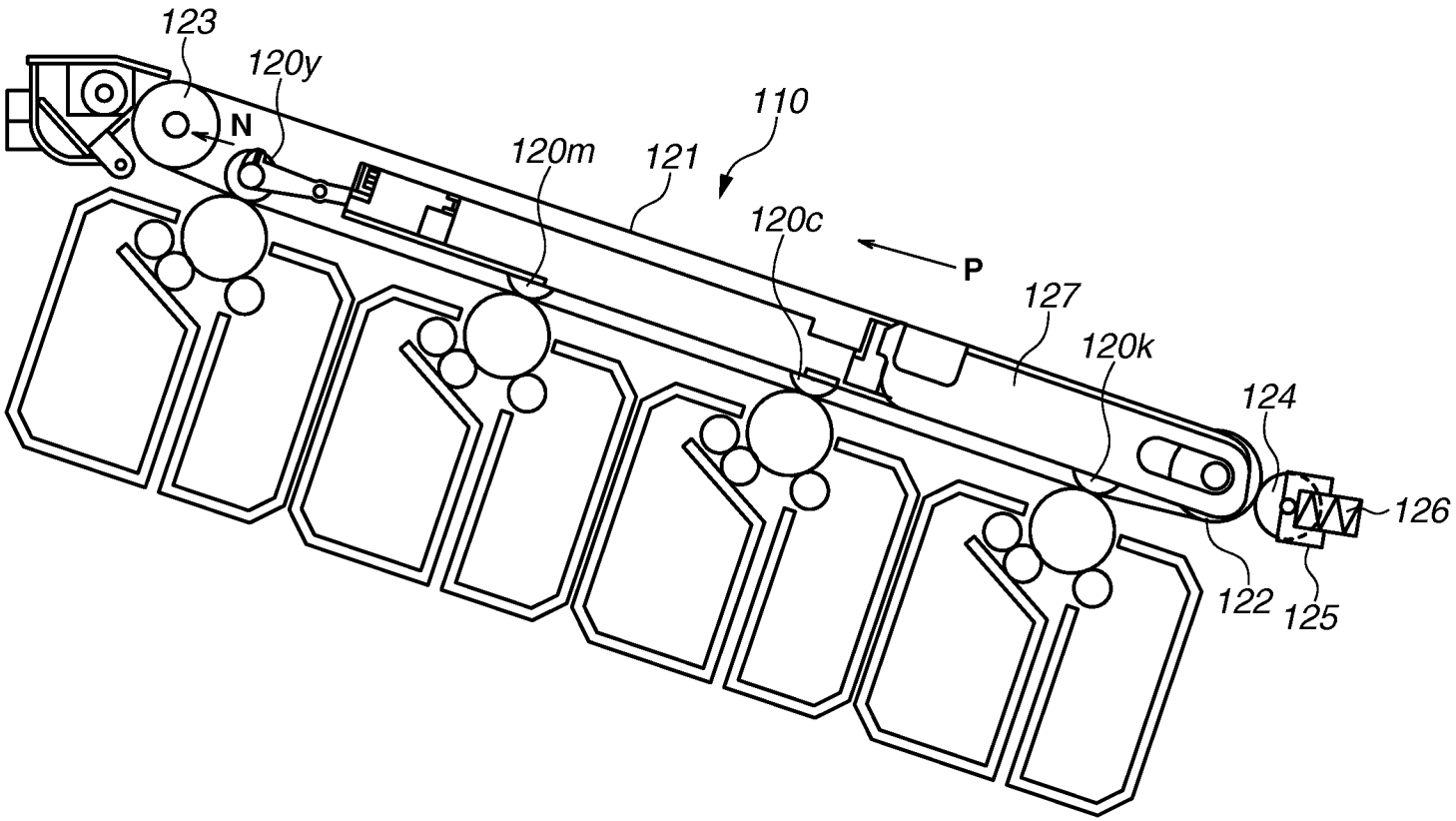
FIG. 9 is a sectional view illustrating an intermediate transfer unit and the periphery thereof when a full-color image is formed by an image forming apparatus according to a second exemplary embodiment.

An intermediate transfer unit 110 of the present exemplary embodiment is described in detail with reference to FIG. 9. FIG. 9 is a sectional view illustrating the intermediate transfer unit 110 and the periphery thereof when a full-color image is formed by the printer.

The intermediate transfer unit 110 includes primary transfer rollers 120 (primary transfer rollers 120*y*, 120*m*, 120*c*, and 120*k* for yellow, magenta, cyan, and black, respectively), an intermediate transfer belt 121, a drive roller 122, and a tension roller 123. The intermediate transfer belt 121 is an endless belt in a cylindrical shape. The intermediate transfer belt 121 is tightly stretched by two shafts that are the drive roller 122 serving as an opposing roller and the tension roller 123 serving as a stretching roller. The intermediate transfer belt 121 can contact photosensitive drums, and makes a circular movement. The tension roller 123 serving as the stretching roller is urged by an urging member (not illustrated) in a direction indicated by an arrow N illustrated in FIG. 9 to apply a predetermined tension to the intermediate transfer belt 121. When the drive roller 122 serving as the opposing roller is rotated by a motor (not illustrated) provided in an apparatus main body of the printer, the intermediate transfer belt 121 circularly moves in a direction indicated by an arrow P illustrated in FIG. 9 at a predetermined speed.

Since the configuration for performing primary transfer of the present exemplary embodiment is substantially the same as that of the first exemplary embodiment, description thereof is omitted.

Secondary transfer is performed at a secondary transfer portion formed by the drive roller 122 and a secondary transfer roller 124. Both of shaft ends of the secondary transfer roller 124 are rotatably held by bearings 125. The secondary transfer roller 124 is pressed against the drive roller 122 by a spring 126 serving as a second urging member via the intermediate transfer belt 121, thereby forming a secondary transfer nip.

At the secondary transfer nip, since a relatively high transfer bias is applied to form a transfer electric field on a transfer material such as paper through which it is difficult to conduct electricity. Thus, the secondary transfer nip portion needs to be wider and have good adhesiveness. Accordingly, the spring 126 serving as the second urging member for the secondary transfer roller 124 is generally set to have a relatively strong force. In the present exemplary embodiment, the spring 126 is set to have an urging force of 50 N.

In a case where the secondary transfer portion continues to be formed while the secondary transfer roller 124 is left for a long time in a state of being pressed and contacted with high pressure, the secondary transfer roller 124 is plastically deformed by a creep phenomenon. Such plastic deformation of the secondary transfer roller 124 reduces adhesiveness between a transfer material and the intermediate transfer belt 121 at the secondary transfer nip portion, causing generation of an abnormal image. Therefore, a unit for causing the secondary transfer roller 124 to contact and be separated from the intermediate transfer belt 121 is provided to prevent the plastic deformation of the secondary transfer roller 124.

Next, a description is given of the configuration for causing the secondary transfer roller 124 to contact and be separated from the intermediate transfer belt 121 according to image formation such as a monochrome image and a full-color image. In the present exemplary embodiment, components that differ from the first exemplary embodiment are described with reference to FIG. 10. In particular, only the shape and arrangement of a lever for contact and separation of the secondary transfer roller 124 are different from those in the first exemplary embodiment.

As illustrated in FIG. 9, a small lever 127 is arranged between an upper surface and a lower surface of the intermediate transfer belt 121 without extending out. In the present exemplary embodiment, the upper surface of the intermediate transfer belt 121 represents a primary transfer surface of the intermediate transfer belt 121. The primary transfer surface opposes the plurality of photosensitive drums 5 between the drive roller 122 and the tension roller 123 of the intermediate transfer belt 121. The lower surface of the intermediate transfer belt 121 represents a surface that opposes the primary transfer surface between the drive roller 122 and the tension roller 123. In other words, the small lever 127 is arranged between the primary transfer surface and the surface opposing the primary surface of the intermediate transfer belt 121 without extending out.

Figure 10:
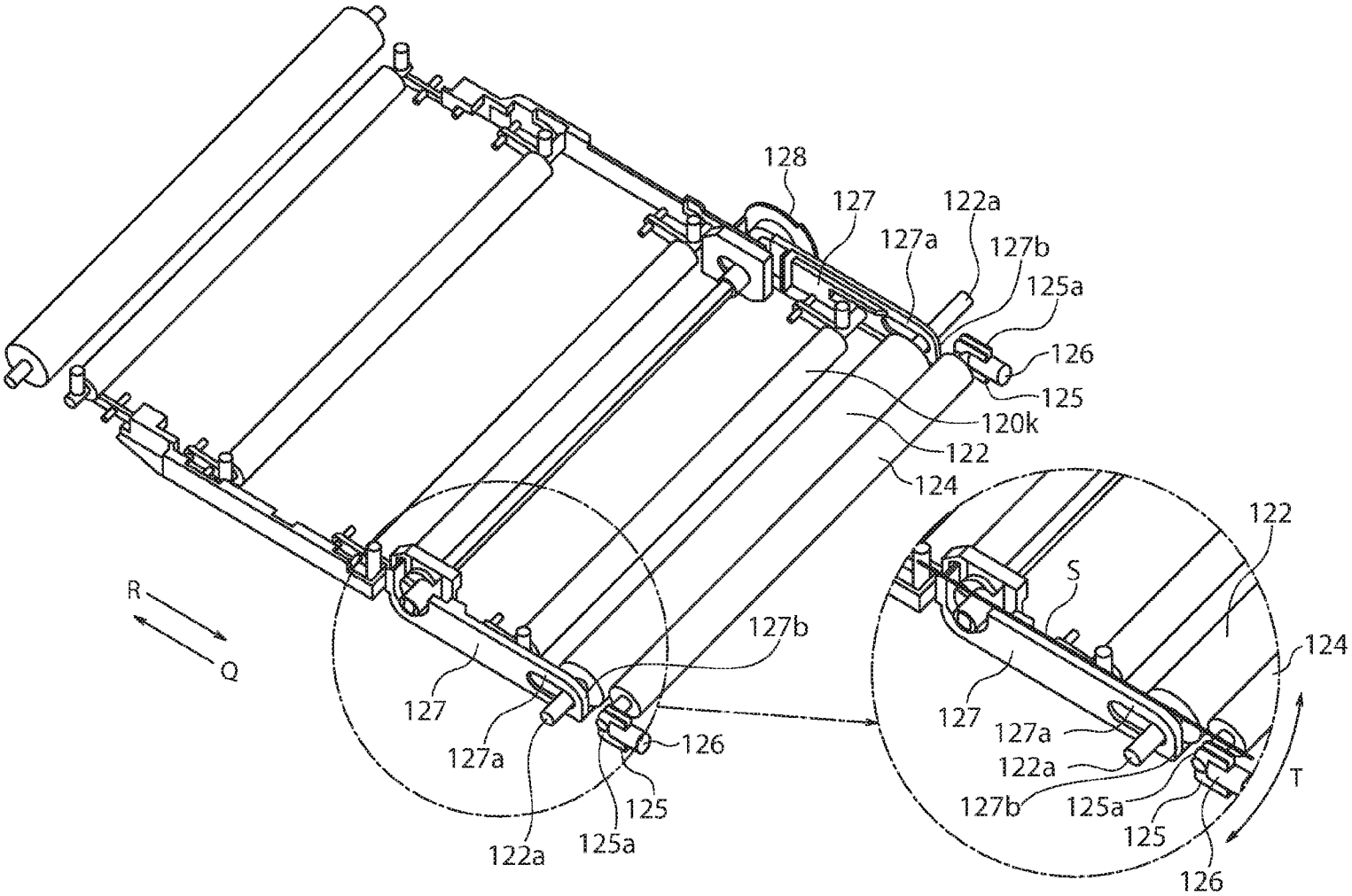
FIG. 10 is a perspective view illustrating a primary transfer unit illustrated in FIG. 9 as seen from diagonally above when an intermediate transfer belt according to the second exemplary embodiment is removed.

As illustrated in FIG. 10, with rotation of a separation shaft unit 128, the small lever 127 makes a reciprocating movement in directions indicated by arrows Q and R illustrated in FIG. 10. The small lever 127 is made of resin having good sliding property. In the present exemplary embodiment, POM is used for the small lever 127. Moreover, the small lever 127 includes an arm 127*a* and a plane 127*b*. The arm 127*a* is arranged in the immediate vicinity of the intermediate transfer belt 121 in such a manner that the arm 127*a* straddles a metal core 122*a* of the drive roller 122 to protrude toward the secondary transfer roller 124 side. The plane 127*b* is engaged with a plane 125*a* provided on the bearing 125 of the secondary transfer roller 124, so that the secondary transfer roller 124 contacts and is separated from the intermediate transfer belt 121. Moreover, the spring 126 presses an area of the bearing 125 engaged with a metal core of the secondary transfer roller 124, and the arm 127*a* is arranged on substantially the same straight line with the spring 126 and the bearings 125. In other words, the spring 126, the bearings 125, and the arm 127*a* are aligned on a straight line S illustrated in FIG. 10 at both ends in a width direction perpendicular to a rotational movement direction of the intermediate transfer belt 121. Therefore, the small lever 127 and the arm 127*a* are not subjected to a momentum force (a force in a direction indicated by an arrow T illustrated in FIG. 10) applied by the spring 126. Herein, the configuration of the front side illustrated in FIG. 10 has been described. A configuration of the rear side in FIG. 10 is substantially the same as that of the front side.

When the printer is not only in a print standby state, but also in monochrome image forming operation and full-color image forming operation, a state of the primary transfer rollers 120 and the secondary transfer roller 124 with respect to the intermediate transfer belt 121 is substantially the same as that in the first exemplary embodiment.

According to the present exemplary embodiment, even when the intermediate transfer unit 110 is stretched by the two shafts, effects similar to the first exemplary embodiment are achieved.

In each of the above-described exemplary embodiments, the image forming apparatus includes four image forming units. However, the number of image forming units is not limited thereto. The number of image forming units may be changed as needed.

In each of the above-described exemplary embodiments, the primary transfer roller is described as a contact member. However, another member may be used as long as the member can contact the inner peripheral surface of the intermediate transfer belt. For example, a roller that causes the belt to protrude toward the photosensitive member may be used as a contact member so that the belt is wound around the photosensitive drum.

Further, in each of the above-described exemplary embodiments, the process cartridge detachable from the image forming apparatus is described. The process cartridge integrally includes the photosensitive drum, the charging unit serving as a process unit for acting on the photosensitive drum, the developing unit, and the cleaning unit. However, the process cartridge is not limited thereto. The process cartridge may integrally include at least one of a charging unit, a developing unit, and a cleaning unit in addition to a photosensitive drum.

Further, in each of the above-described exemplary embodiments, the process cartridge including the photosensitive drum is detachable from the image forming apparatus. However, a configuration of the image forming apparatus is not limited thereto. For example, each of components may be mounted in the image forming apparatus, or each of components may be detachable from the image forming apparatus.

Further, in each of the above-described exemplary embodiments, the printer is described as an image forming apparatus. However, aspects of the present invention are not limited to the printer. For example, an image forming apparatus such as a copying machine and a facsimile machine may be used. Alternatively, an image forming apparatus such as a multifunction peripheral including a combination of copying and facsimile functions may be used. Aspects of the present invention may be applied to such image forming apparatuses, so that advantages similar to the above-described exemplary embodiments can be achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-092383 filed Apr. 28, 2014, which is hereby incorporated by reference herein in its entirety.

What is claimed is:

1. An image forming apparatus comprising:

a photosensitive member configured to bear a toner image;

a transfer unit to which the toner image is primarily transferred from the photosensitive member, and including an endless belt configured to contact the photosensitive member and circularly move, a contact member arranged corresponding to the photosensitive member and configured to contact and be separated from the belt, and a moving member configured to move to cause the contact member to contact and be separated from the belt;

a secondary transfer member configured to contact and be separated from an outer peripheral surface of the belt to secondarily transfer the toner image from the belt to a transfer material; and an urging member configured to urge the secondary transfer member toward the transfer unit, wherein the moving member includes an acting portion configured to cause the secondary transfer member to move in a direction opposite to an urging direction of the urging member, and the moving member moves the contact member and the secondary transfer member by sliding in a direction substantially parallel to a surface of the belt configured to contact the photosensitive member.

2. The image forming apparatus according to claim 1, wherein the moving member is provided within a region formed by an inner peripheral surface of the belt.

3. The image forming apparatus according to claim 1, wherein the moving member separates the secondary transfer member from the belt by using the acting portion.

4. The image forming apparatus according to claim 3, wherein the contact member contacts the belt by the movement of the moving member when the secondary transfer member contacts the belt.

5. The image forming apparatus according to claim 1, wherein the transfer unit includes a first stretching roller configured to stretch an inner peripheral surface of the belt, and a second stretching roller configured to stretch the inner peripheral surface of the belt, wherein the secondary transfer member is configured to contact and separate from a surface of the belt formed between the first stretching roller and the second stretching roller, and wherein the moving member slides within a space formed between a position at which the first stretching roller is arranged and a position at which the second stretching roller is arranged.

6. The image forming apparatus according to claim 5, wherein the transfer unit includes a third stretching roller configured to form a primary transfer surface, where the photosensitive member contacts the belt, with the second stretching roller, and wherein the second stretching roller is arranged on a downstream side of the third stretching roller and an upstream side of the first stretching roller in a movement direction of the belt.

7. The image forming apparatus according to claim 1, further comprising a bearing configured to hold a shaft of the secondary transfer member, wherein the urging member urges the bearing, and wherein the urging member, the bearing, and the moving member are aligned in a direction parallel to an urging direction of the urging member.

8. The image forming apparatus according to claim 1, wherein the transfer unit includes a shaft configured to be rotated by a driving force transmitted from an image forming apparatus main body, and a cam portion provided on the shaft, and wherein the moving member moves by contacting a part of the cam portion.

9. The image forming apparatus according to claim 8, further comprising another photosensitive member configured to bear a toner image of a color different from that of the photosensitive member, wherein the transfer unit includes another contact member arranged corresponding to the other photosensitive member and configured to contact and be separated from the belt, and another moving member configured to cause the another contact member to contact and be separated from the belt.

10. The image forming apparatus according to claim 9, wherein the cam portion includes a first contacting portion configured to contact the moving member, and a second contacting portion configured to contact the another moving member.

11. The image forming apparatus according to claim 10, wherein the moving member and the another moving member are arranged at positions facing each other across the cam portion in a direction perpendicular to an axial direction of the shaft.

12. An image forming apparatus, comprising:

a photosensitive member configured to bear a toner image;

a transfer unit to which the toner image is primarily transferred from the photosensitive member, and including an endless belt configured to contact the photosensitive member and circularly move, a first stretching roller configured to stretch an inner peripheral surface of the belt, a second stretching roller configured to stretch the inner peripheral surface of the belt, a contact member arranged corresponding to the photosensitive member and configured to contact and be separated from the belt, and a moving member configured to move to cause the contact member to contact and be separated from the belt;

a secondary transfer member configured to contact and be separated from an outer peripheral surface of the belt formed between the first stretching roller and the second stretching roller to secondarily transfer the toner image from the belt to a transfer material; and an urging member configured to urge the secondary transfer member toward the transfer unit, wherein the moving member includes an acting portion configured to cause the secondary transfer member to move in a direction opposite to an urging direction of the urging member, and the moving member moves the contact member and the secondary transfer member, and wherein the moving member slides within a space formed between a position at which the first stretching roller is arranged and a position at which the second stretching roller is arranged.

13. The image forming apparatus according to claim 12, wherein the moving member slides in a direction substantially parallel to a surface of the belt configured to contact the photosensitive member.

14. The image forming apparatus according to claim 12, wherein the moving member is provided within a region formed by the inner peripheral surface of the belt.

15. The image forming apparatus according to claim 12, wherein the transfer unit includes a third stretching roller configured to form a primary transfer surface, where the photosensitive member contacts the belt, with the second stretching roller, and wherein the second stretching roller is arranged on a downstream side of the third stretching roller and an upstream side of the first stretching roller in a movement direction of the belt.

16. The image forming apparatus according to claim 12, wherein the transfer unit includes a shaft configured to be rotated by a driving force transmitted from an image forming apparatus main body, and a cam portion provided on the shaft, and wherein the moving member moves by contacting a part of the cam portion.

* * * * *